US011284683B2

(12) United States Patent
Bixby

(10) Patent No.: US 11,284,683 B2
(45) Date of Patent: Mar. 29, 2022

(54) DECORATIVE CONNECTOR FOR JEWELRY

(71) Applicant: Barbara Bixby, Dover Plains, NY (US)

(72) Inventor: Barbara Bixby, Dover Plains, NY (US)

( * ) Notice: Subject to any disclaimer, the term of this patent is extended or adjusted under 35 U.S.C. 154(b) by 0 days.

(21) Appl. No.: 17/033,320

(22) Filed: Sep. 25, 2020

(65) Prior Publication Data

US 2021/0085040 A1 Mar. 25, 2021

Related U.S. Application Data

(60) Provisional application No. 62/905,548, filed on Sep. 25, 2019.

(51) Int. Cl.

| | |
|---|---|
| ***A44C 13/00*** | (2006.01) |
| ***A44C 25/00*** | (2006.01) |
| ***A44C 5/02*** | (2006.01) |
| ***A44C 5/12*** | (2006.01) |

(52) U.S. Cl.

CPC ..... *A44C 5/12* (2013.01); *A44C 25/001* (2013.01)

(58) Field of Classification Search

CPC ..... A44C 5/12; A44C 25/001; A44C 13/00; A44C 15/005; F16B 45/022; F16B 45/023; F16B 45/02; F16B 45/024

See application file for complete search history.

(56) References Cited

U.S. PATENT DOCUMENTS

| | | | | |
|---|---|---|---|---|
| 206,335 A * | 7/1878 | Kampf | F16G 13/14 59/90 |
| 1,797,968 A * | 3/1931 | Sweeney | A44C 5/102 59/80 |
| 3,930,290 A * | 1/1976 | Mangels | B66C 1/36 114/108 |
| 2009/0144950 A1* | 6/2009 | Archer, Jr. | F16B 45/02 24/598.2 |
| 2019/0191830 A1* | 6/2019 | Ruiz | A44C 25/001 |

* cited by examiner

*Primary Examiner* — Jack W Lavinder

(74) *Attorney, Agent, or Firm* — Ostrolenk Faber LLP

(57) ABSTRACT

The invention is directed to a decorative connector for forming a jewelry item, said decorative connector comprising: a decorative member having oppositely located sections, said decorative member comprising a loop at one of said oppositely located sections, said decorative member comprising a decorative body, said loop having a first end fixedly attached to the body of said decorative member, a second end of said loop removably connected to the body of said decorative member to open said loop, the connections between said loop and said body of said decorative member being substantially hidden from view, a passageway through the other of said oppositely located sections of said decorative member, said passageway enabling connecting said decorative connector to a jewelry item.

7 Claims, 9 Drawing Sheets

DECORATIVE CONNECTOR FOR JEWELRY

CROSS-REFERENCE TO RELATED APPLICATION

The present non-provisional patent application claims the benefit of and priority to U.S. Provisional Patent Application No. 62/905,548, filed Sep. 25, 2019, by Barbara Bixby, and entitled "DECORATIVE CONNECTOR FOR JEWELRY," the entire contents of which are incorporated herein by reference.

BACKGROUND OF THE INVENTION

This invention relates to a decorative connector for forming jewelry items such as bracelets and necklaces.

Decorative connectors for bracelets and pendants exist, and these are formed generally of a circular or link type shape, allowing individual decorative elements to be connected together.

In some cases, a decorative connector can also serve as an end element for a clasp.

This invention relates to a novel structure for such decorative connectors which allow the connector to serve either as a clasp or as one of several links forming a bracelet or necklace.

The decorative connector has a decorative body such that the connector independently enhances the jewelry item itself. More particularly, the decorative connector has oppositely located sections and a loop connected at one of said oppositely located sections. The decorative member has a decorative body which substantially hides the functional connecting activity but also presents a decorative element forming part of the jewelry item.

The loop has a first end fixably attached to the body of the decorative member and a second end of the loop removably connected to the body to open the loop. The loop may be formed of a hinged two member assembly. The connections between the loop and the body of the decorative member are substantially hidden from view. The decorative connector further comprises a passageway in the other of the oppositely located sections of the decorative member, the passageway enabling connecting the decorative connector to the second decorative connector or to form a clasp closing the jewelry charm or necklace.

The invention may be more fully understood from the below description.

SUMMARY OF THE INVENTION

In a preferred embodiment, the invention is directed to a decorative connector for forming a jewelry item, said decorative connector comprising: a decorative member having oppositely located sections, said decorative member comprising a loop at one of said oppositely located sections, said decorative member comprising a decorative body, said loop having a first end fixedly attached to the body of said decorative member, a second end of said loop removably connected to the body of said decorative member to open said loop, the connections between said loop and said body of said decorative member being substantially hidden from view, a passageway through the other of said oppositely located sections of said decorative member, said passageway enabling connecting said decorative connector to a jewelry item.

Other features and advantages of the present invention will become apparent from the following description of the invention which refers to the accompanying drawings.

DETAILED DESCRIPTION OF EMBODIMENTS OF THE INVENTION

Figure 1:
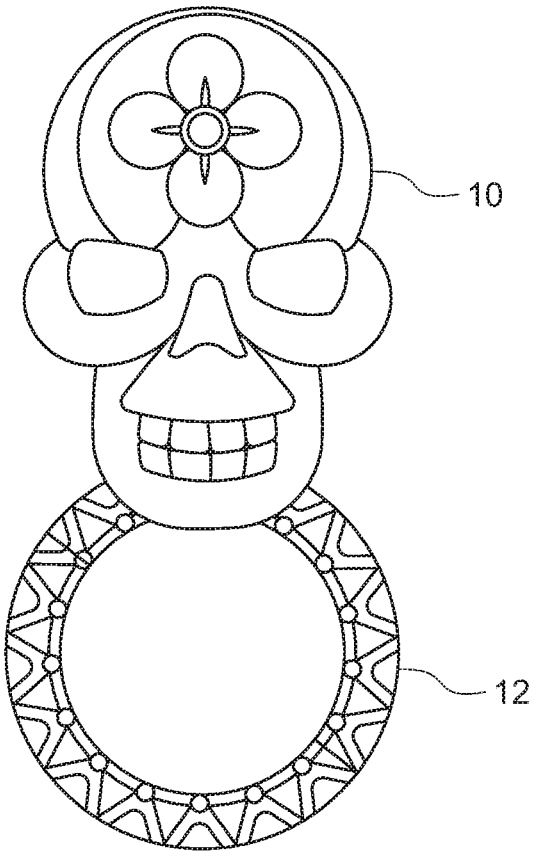
FIG. 1 is a top view of a decorative connector of this invention.
Figure 2:
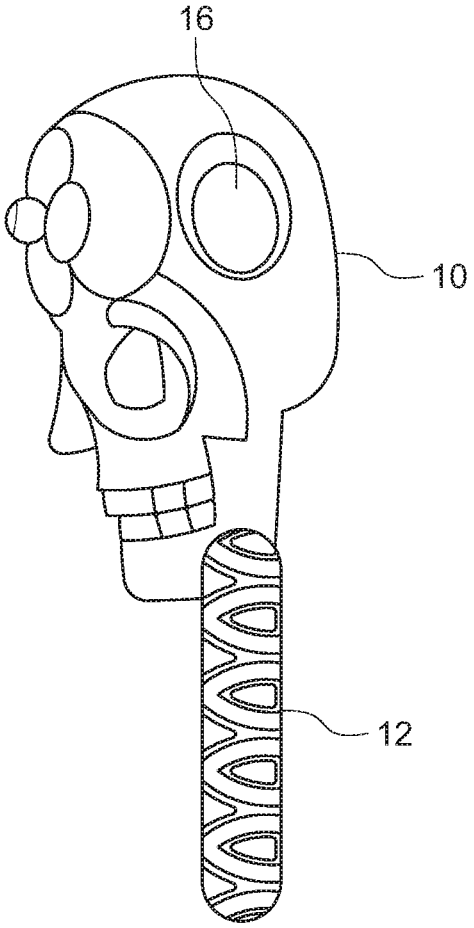
FIG. 2 is a side view of the decorative connector of FIG. 1.
Figure 3:
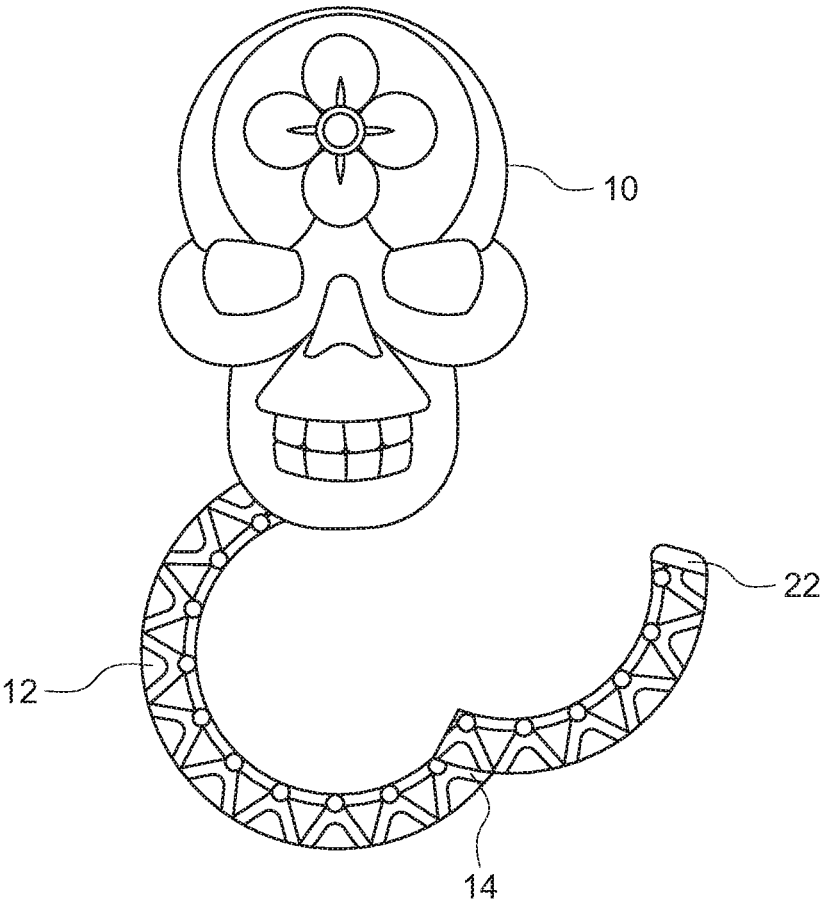
FIG. 3 is a top view of the decorative connector of FIG. 1 showing a hinged loop in an open position.

FIGS. 1 and 2 are top and side views of a decorative connector 10 with loop 12 shown in the closed position in FIG. 1 and in the open position in FIG. 3. Loop 12 may be hinged as at 14 to assist in the opening and closing functions. FIG. 2 which shows the decorative connector from the side shows a passageway or opening 16 located in the head of the decorative connector.

Figure 4:
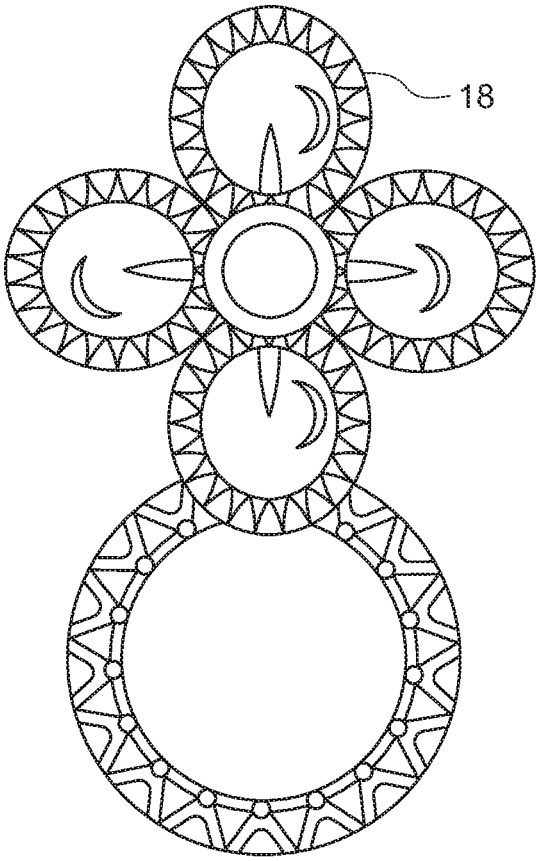
FIGS. 4 and 5 are top and side views respectively of a different decorative connector comprising the same elements shown in FIGS. 1-3.
Figure 5:
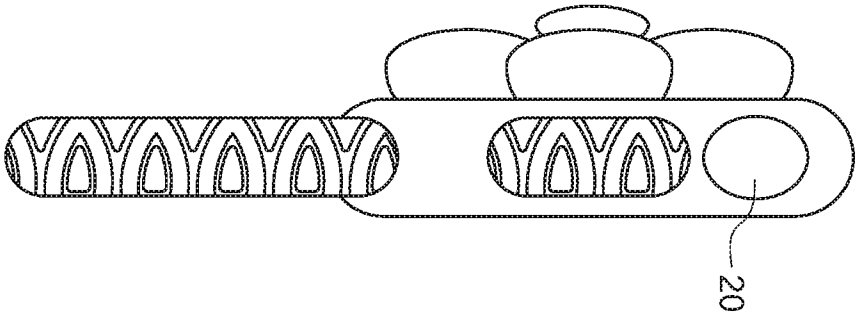

FIGS. 1-3 show a skull as a decorative connector, while FIGS. 4 and 5 show the decorative connector as a cloverleaf 18. Passageway 16, which is shown in FIG. 2, is seen as opening 20 shown in FIG. 5 relating to the decorative connector being a cloverleaf.

Figure 6:
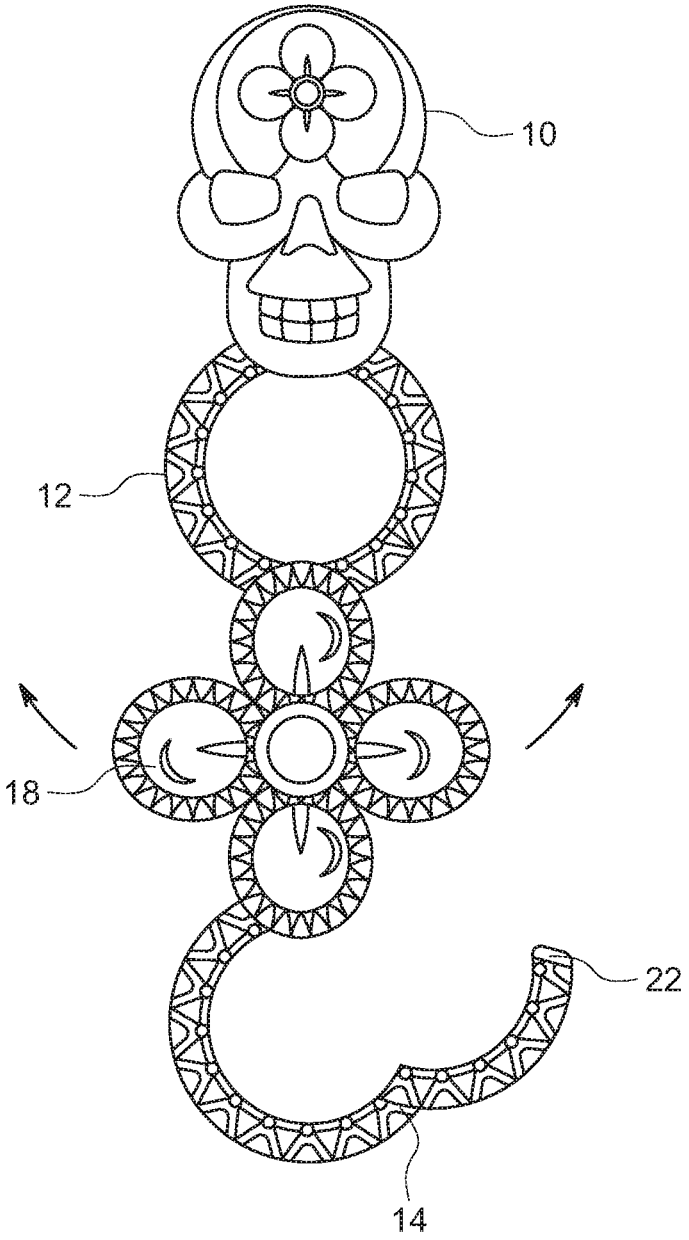
FIG. 6 is a top view showing two of the decorative connectors connected together with the bottom decorative connector having its loop in the open position allowing for a further connection thereto.

FIG. 6 shows two decorative connectors, each with different decorative bodies, as shown in FIGS. 1-5 with a skull decorative body 10 attached to the cloverleaf decorative body 18 through loop 12 passing through opening 20 connecting the two decorative connectors together.

Figure 9:
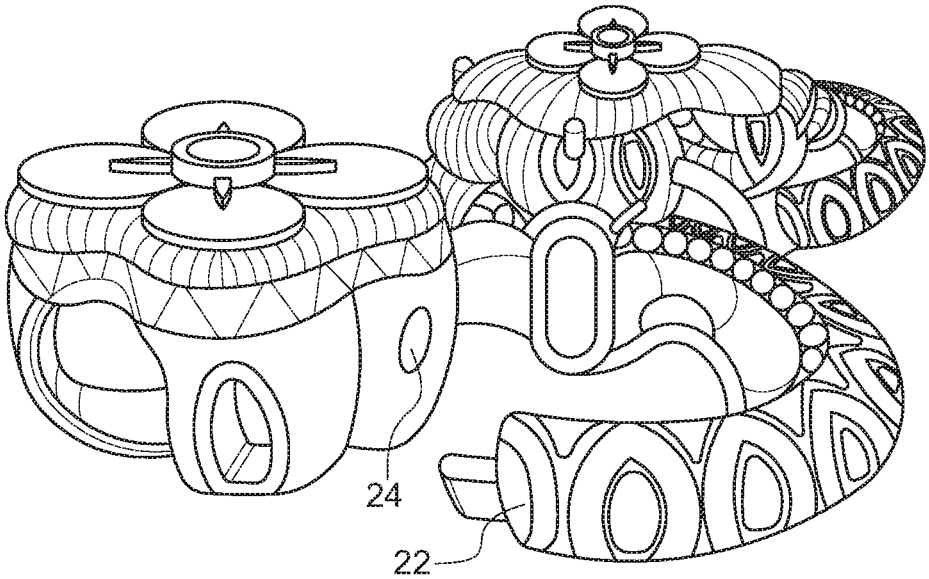
FIG. 9 is an end view of the decorative connector showing the detail between the loop and a receptacle in the adjoining decorative member to which the loop is attached.

FIG. 9 is an edge view showing a tab 22 projecting from an open end of loop 12 which is captured in receptacle 24 formed in the decorative body which makes up the decorative element. The connection between tab 22 and receptacle 24 is hidden from view when the decorative connectors are connected together.

The loops, themselves, may be substantially decorative also, so each of the individual elements or portions of a plurality of decorative connectors connected together present decorative and appealing appearances when the decorative connectors are connected together to form a bracelet or necklace.

Passageway 16 enables connection between adjoining decorative connectors. The decorative connectors shown in the Figures may also serve as a clasp so that loop 12 may be one end of a bracelet or necklace which then connects to the decorative connector, thereby closing the bracelet or necklace.

Figure 7:
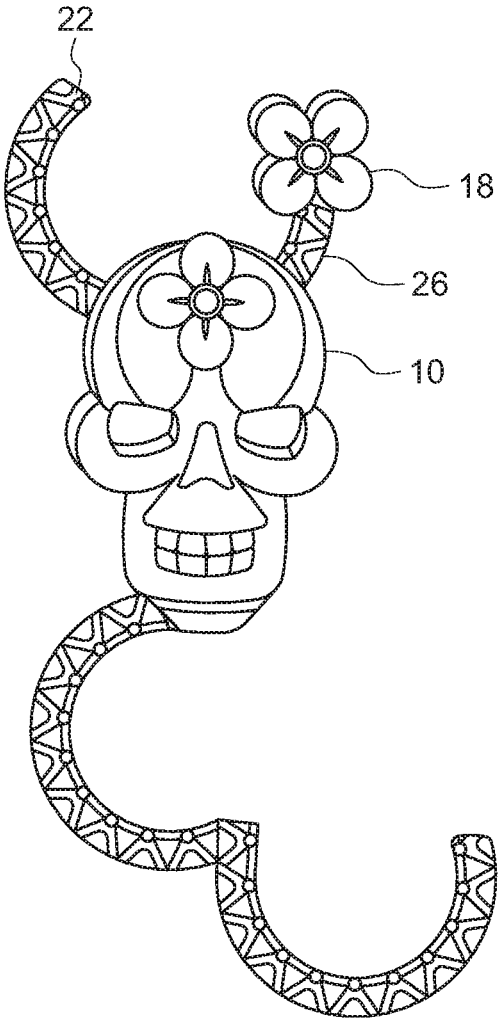
FIG. 7 is a photograph similar to FIG. 6 in which the decorative member is shown with both upper and lower loops in the open position.
Figure 8:
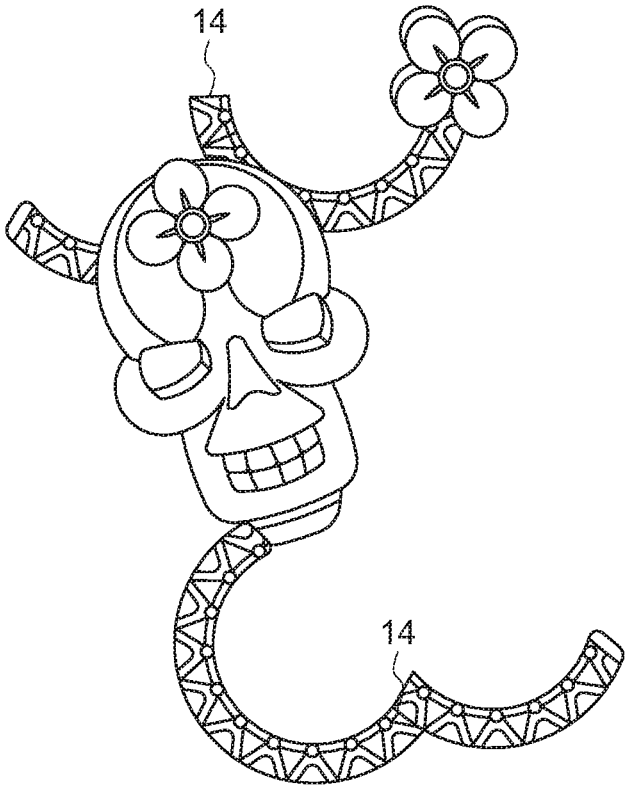
FIG. 8 is similar to FIG. 7 but shows the upper loop to be hinged and connected through a hole in the upper portion of the decorative skull.

FIGS. 7 and 8 show two decorative connectors 10 and 18 with decorative connector 18 passing through passageway 16 in the top of decorative skull 10, while tab 22 is captured in receptacle 24 which is substantially hidden from view.

FIG. 8 specifically shows that both the upper and lower loops are formed of hinged members which facilitate easy assembly and connection of the decorative connectors with hinge 14 shown in both the upper and lower loop sections.

While the Figures suggest that the decorative connectors have upper and lower sections, these could also be considered as oppositely located sections which could also be considered as located on opposite sides of the decorative connectors.

Passageway 20 passes completely through the upper portion of the skull decorative connector shown in FIGS. 1-3 and passageway 20 passes through the upper section of the cloverleaf shown in FIGS. 4 and 5.

LIST OF ELEMENTS IN THE FIGURES

10 Decorative connector/decorative body
12 Loop
14 Hinge
16 Passageway
18 Decorative connector/decorative body
20 Passageway
22 Tab
24 Receptacle It should be understood that the preferred embodiment was described to provide the best illustration of the principles of the invention and its practical application to thereby enable one of ordinary skill in the art to utilize the invention in various embodiments and with various modifications as are suited to the particular use contemplated.

Although the present invention has been described in relation to particular embodiments thereof, many other variations and modifications and other uses will become apparent to those skilled in the art. It is preferred, therefore, that the present invention be limited not by the specific disclosure herein, but only by the appended claim.

What is claimed is:

1. A decorative connector for forming a jewelry item, said decorative connector comprising:

a decorative member having oppositely located sections, said decorative member comprising a loop at one of said oppositely located sections, said decorative member comprising a decorative body having a shaped surface that is not loop-shaped and that serves only to provide a viewable decorative appearance, said loop having a first end fixably attached to the body of said decorative member, a second end of said loop removably connected to the body of said decorative member to open said loop via connection elements, the connections elements between said loop and said body of said decorative member being substantially hidden from view, a passageway through the other of said oppositely located sections of said decorative member, said passageway enabling connecting said decorative connector to a jewelry item.

2. The decorative connecter of claim 1, wherein the decorative body is skull-shaped.

3. The decorative connecter of claim 1, wherein the decorative body is flower-shaped.

4. The decorative connecter of claim 1, including a plurality of decorative members, each said decorative member comprising its respective loop and decorative body and the plurality of decorative members being configured to be removably interlinked with one another.

5. The decorative connecter of claim 1, wherein the connection elements comprise a receptacle and a tab insertable and lockable within said receptacle.

6. The decorative connecter of claim 5, wherein the receptacle and the tab are hidden from view within the decorative body.

7. The decorative connecter of claim 1, wherein the decorative body comprises a plurality of round bodies connected to each other, and each round body bearing a decoration on a front surface thereof.

* * * * *